US005979171A

United States Patent [19]

Mitchell et al.

[11] Patent Number: 5,979,171

[45] Date of Patent: Nov. 9, 1999

[54] HEAT EXCHANGER SLAB ASSEMBLY HAVING IMPROVED CONDENSATE RETAINING FEATURES

[75] Inventors: Charles Anthony Mitchell, Indianapolis; Floyd Joseph Frenia, Brownsburg; Loren Dean Hoffman, Indianapolis; Thomas Kenneth Rembold, Danville, all of Ind.

[73] Assignee: Carrier Corporation, Farmington, Conn.

[21] Appl. No.: 09/016,603

[22] Filed: Jan. 30, 1998

[51] Int. Cl.[6] ..... F25D 21/14

[52] U.S. Cl. ..... 62/288; 62/272; 165/122

[58] Field of Search ..... 62/272, 285, 288, 62/289, 291, 515, 519, 524; 165/122, 124

[56] References Cited

U.S. PATENT DOCUMENTS

| | | | |
|---|---|---|---|
| 3,404,539 | 10/1968 | Laing | 62/262 |
| 4,000,779 | 1/1977 | Irwin | 165/111 |
| 4,832,116 | 5/1989 | Easton | 165/126 |
| 5,388,426 | 2/1995 | Wada et al. | 62/363 |
| 5,904,053 | 5/1999 | Polk et al. | 62/285 |

*Primary Examiner*—Henry Bennett
*Assistant Examiner*—Marc Norman
*Attorney, Agent, or Firm*—Wall Marjama Bilinski & Burr

[57] ABSTRACT

A condensate retaining apparatus for use with a refrigeration heat exchanger having at least two plannar slabs mounted in an air duct. Each slab has an upper and lower end and forms an oblique angle with respect to the direction of air flow and further includes a coil for conducting a fluid and a plurality of form defining channels for conducting condensate toward the lower end of the slab. The slabs are mounted so that the lower end of each overlying slab is offset inwardly from the upper end of the nearest underlying slab with each pair of adjacent slab ends defining an apex of the heat exchanger. The apex is covered to prevent condensate from being entrained in that air flow and as well as being shielded from the air flow.

20 Claims, 4 Drawing Sheets

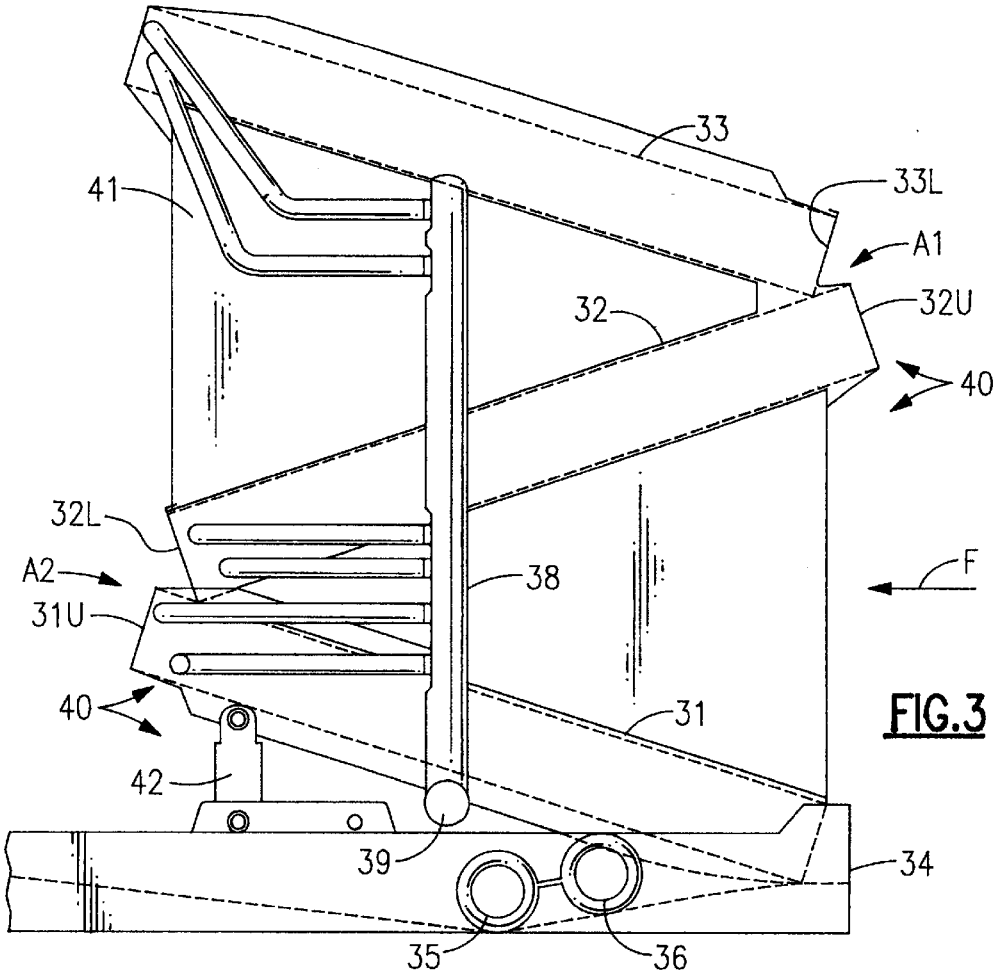
FIG.3
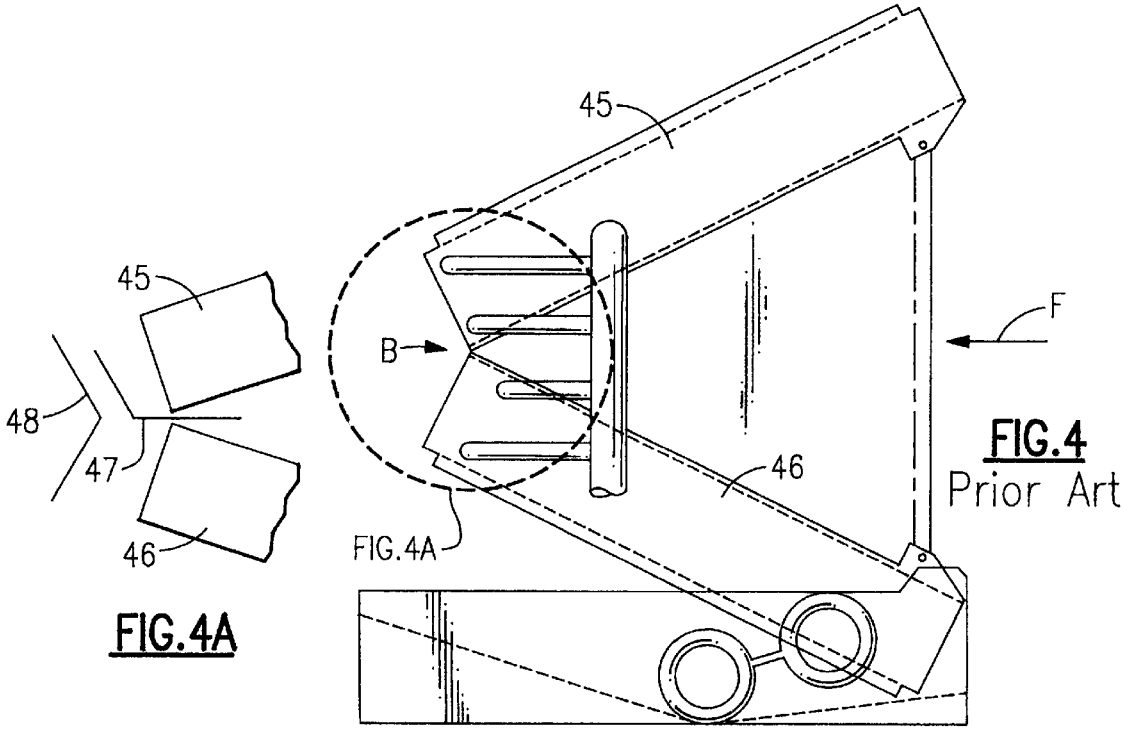
FIG.4
Prior Art
FIG.4A

HEAT EXCHANGER SLAB ASSEMBLY HAVING IMPROVED CONDENSATE RETAINING FEATURES

BACKGROUND OF THE INVENTION

The present invention relates to heat exchangers and fan coils of the type used in refrigeration and air conditioning systems, and is directed more particularly to a heat exchanger slab assembly that has improved condensate retention properties.

All refrigeration and air conditioning systems intake relatively warm air that has an unknown moisture content and discharges air at a reduced temperature. In the process, intake air is passed over fan coils or other heat exchangers which carry refrigerant liquids, such as ammonia or water, which have a temperature lower than that of the intake air. As this occurs, the moisture in the air condenses on the fins of the fan coils or heat exchangers, and forms droplets of water that eventually become large enough to flow under the force of gravity. This condensate water then flows along the surface of the fins until it reaches a pan or tube from or through which it can be drained off.

An important consideration in the handling of condensate is the need to prevent it from being blown off of the fins and entrained in the air flowing out of the heat exchanger or fan coil. This is because such entrained moisture flows through the duct system of the space to be cooled, where it can cause moisture damage, rot and mildew. The problem of preventing condensate from flowing off of the fins of heat exchangers and fan coils is complicated by the fact that, in order to provide the maximum possible surface area for heat exchange, heat exchangers and fan coils are often made up of two or more generally planar heat exchanger subassemblies, commonly referred to as slabs, which have their planes oriented obliquely with respect to the direction of air flow and which, together, occupy the height and width of the duct within which they are located. In one configuration, known as an "A coil", two slabs are formed into an A or V shaped slab assembly the apex of which points either upstream into or downstream from the air flow. In another configuration, known as an "N coil" three slabs are formed into and N or Z shaped slab assembly having a first apex that points upstream and a second apex which points downstream.

The retention of condensate in multi-slab slab assemblies is relatively straightforward in heat exchangers in which the slabs are mounted vertically with one slab behind another, i.e. in fluidic series with one another with respect to the air flow through the duct. This is because, in such slab assemblies, condensate that flows down the fins of such slabs under the force of gravity remains in parallel streams which do not cross from slab to slab and which empty into a common catchment tray and from there directed into a drain for disposal. The problem with this vertical orientation is that the downstream ones of the slabs are in the thermal shadow of the upstream slabs and therefore exchange heat less efficiently.

In the case of multi-slab heat exchangers in which the slabs are mounted horizontally with one slab above or below another, i.e., in parallel relationship with respect to the air flow through the duct, the processing of condensate is more difficult. This is because condensate flowing along the fins of such slab assemblies under the force of gravity flows in streams that must cross from one slab to another before reaching their catchment tray, and because condensate is more easily blown off of the slabs as it crosses from one slab to another, i.e., when it is in proximity to the apexes of such slab assemblies.

Prior to the present invention, the problem of retaining condensate within horizontally oriented slab assemblies was dealt with in one of two ways. One of these was to include splitter plates between adjacent slabs. These splitters served to intercept and collect condensate that was blown off of the overlying slabs at the apexes of the slab assembly and direct it downwardly onto the underlying slab thereof. The problem with this solution is that condensate flowing along the surface of the splitter moves toward the edges of the underlying slab, where it is directed into a relatively small number of the fins thereof. Once there, it causes the condensate carrying capacity of these outer fins to be exceeded, thereby allowing condensate to blow off of the slab assembly and become entrained in the air flow leaving the heat exchanger.

Another solution to the problem preventing condensate blow off included the provision, for each overlying slab, of a separate, direct drainage path to the common catchment tray. This solution had the advantage that it eliminated the need for slab-to-slab flow of condensate, but it made the slab assembly and the heat exchanger of which it was a part considerably more complex and expensive. This complexity and expense is compounded by the fact that, for safety reasons, all drainage paths must be provided with a parallel, redundant drainage path that protects the building in which it is used from being flooded as a result of the blockage of any single drainage path.

Thus, prior to the present invention, there has existed a need for a condensate retaining apparatus which is effective, but which also is both simple and inexpensive.

SUMMARY OF THE INVENTION

In accordance with the present invention, there is provided an improved condensate retaining apparatus which is both simple and inexpensive, and which provides the desired condensate retention without using splitter plates, and without requiring that individual drainage paths be provided for each slab.

Generally speaking, the present invention is based in part on the discovery that, if it can be assured that the flow of condensate from an overlying slab can be distributed relatively evenly across among the channels defined by the fins of the adjacent underlying slab, blow off can be prevented without providing separate, individual drainage paths for each slab. This is because, if this condition is met, the channels of the underlying slab are prevented from having their condensate carrying capacities exceeded and thereby allowing condensate to escape from the slab assembly as a whole. The present invention is also based in part on the discovery that the desired relatively even distribution of the flow from an overlying slab to an underlying slab can be assured by so positioning the slabs that the lower tips of the fins at the lower end of each overlying slab are offset with respect to the upper tips of the fins at the upper end of the adjacent underlying slab. Because of this offset positioning, the force of gravity is made to oppose the tendency of condensate to blow off of the slab assembly as it flows from one slab to another.

In the preferred embodiment, this positional relationship is established by introducing a suitable offset between the longitudinal and vertical positions of the ends of the slabs that lie at the apexes of the slab assembly. As used herein, the terms "longitudinal" or "inward" and "outward" refer to directions that lie along the direction in which air flows through the passage in which the heat exchanger is located. The terms "vertical" or "upward" and "downward" refer to those directions that are perpendicular to both the direction of air flow, and to the surface of the earth, while the terms "horizontal" and "lateral" refer to those directions that are perpendicular to the direction of air flow, but parallel to the surface of the earth.

In both preferred and non-preferred embodiments, the condensate retaining apparatus of the invention includes suitable apex end covers, shields or similar structures for preventing condensate from blowing off of the slab assembly at any of the numerous, horizontally distributed points at which condensate flows downwardly out of channels defined by the fins of the overlying slab and into the channels defined by the fins of the underlying slab. These structures have cross-sectional shapes that conform to the cross-sectional shapes of the apexes which they cover, including their respective longitudinal and vertical offsets, and cover at least the portions of the slab ends that are in immediate proximity to the locations at which condensate flows from slab to slab. These structures also preferably have end portions which extend to and over at least the fluidically downstream or trailing edges of the slab ends, thereby eliminating the tendency of condensate to become trapped along these edges by the pressure of the air flowing thereby. In slab assemblies through which air must be able to flow bidirectionally, these end portions preferably extend to and over both the leading and trailing edges of the slab ends.

The offset positioning contemplated by the present invention is compatible with a variety of different spatial relationships between the ends of the slabs which define the apexes of the slab assembly. The adjacent slab ends may, for example, be in such critical proximity to one another that the tips of the fins of the overlying slab are in contact with the upper edges of the respective fins of the underlying slab, a spatial relationship which facilitates and optimizes the retention of condensate during slab to slab transfer. The adjacent slab ends may, on the other hand, be so positioned that the fins of the over and underlying slabs become interleaved, a spatial relationship which also facilitates and optimizes the retention of condensate during slab to slab transfer. Other, less critical spatial relationships, such as those in which a substantial air gap exists between the fins of the over and underlying slabs may also be used, however, provided that the offsets of the present invention are used. It will be understood that all of these spatial relationships, and those variants thereof that would be apparent to those skilled in the art, are within the contemplation of the present invention.

DESCRIPTION OF THE DRAWINGS

Other objects and advantages of the present invention will be apparent from the following description and drawings, in which:

FIG. 3 shows a simplified side view of one embodiment of a slab assembly constructed in accordance with the present invention, with the refrigerant inlet system and the coil ends omitted for the sake of clarity;

FIG. 4 is a simplified side view of a prior art slab assembly, with the refrigerant inlet system and the coil ends omitted for the sake of clarity;

FIG. 4A is a simplified exploded view of the apical portion of the slab assembly of FIG. 4;

DESCRIPTION OF THE PREFERRED EMBODIMENTS

Figure 1A:
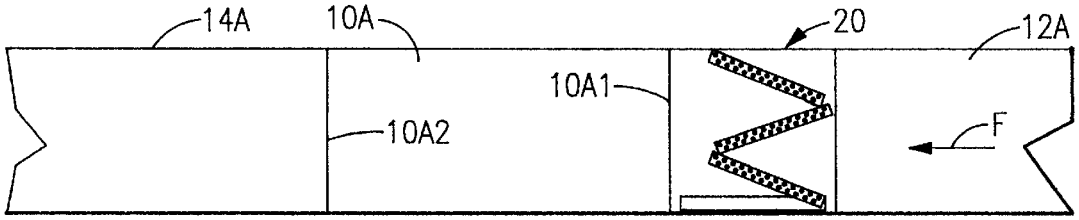
FIGS. 1A and 1B show simplified side views of heat exchangers constructed in accordance with the invention, together with typical blower and duct arrangements of the type with which they are used.
Figure 1B:
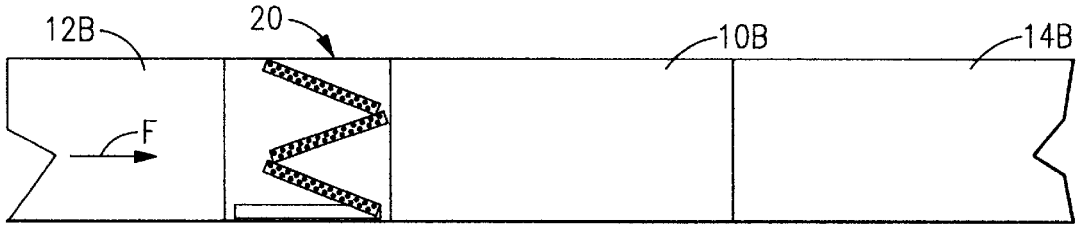

Referring to FIG. 1A, there is shown the blower portion 10A of a heating and cooling unit (not shown) having an inlet 10A1 which is connected to receive intake air through an air inlet duct 12A, and an air outlet 10A2 which is connected to discharge air through an air outlet duct 14A. Connected between blower intake 10A1 and inlet duct 12A is a heat exchanger 20, commonly referred to as a "furnace coil", through which air flows longitudinally from right to left, as indicated by the arrow labeled F in FIG. 1A. When used in the location shown in FIG. 1A, heat exchanger 20 is commonly described as being in the "horizontal furnace right" position. The blower, ducts and heat exchanger shown in FIG. 1B are similar to those shown in FIG. 1A, like functioning parts being similarly numbered (except for a difference in postscript), except that heat exchanger 20 is the position commonly described as "horizontal furnace left". Because heat exchanger 20 operates in the same way, without regard to the direction of air flow therethrough, the heater exchangers of FIGS. 1 A and 1 B are identical, as indicated by the absence of a postscript after the label 20.

When the heating and cooling unit operates in its heating mode, heat exchanger 20 is unused and no refrigerant is pumped therethrough. When the heating and cooling unit is operating in its cooling mode, however, a refrigerant liquid such as water or ammonia is pumped through heat exchanger 20 to cool the air entering the blower unit. As this air is cooled, a considerable amount of moisture condenses therefrom. In order to retain and drain off this condensed water or condensate, heat exchanger 20 makes use of the offset construction of the invention. This offset construction will now be described with reference to FIGS. 2 , 3 and 5.

Figure 2:
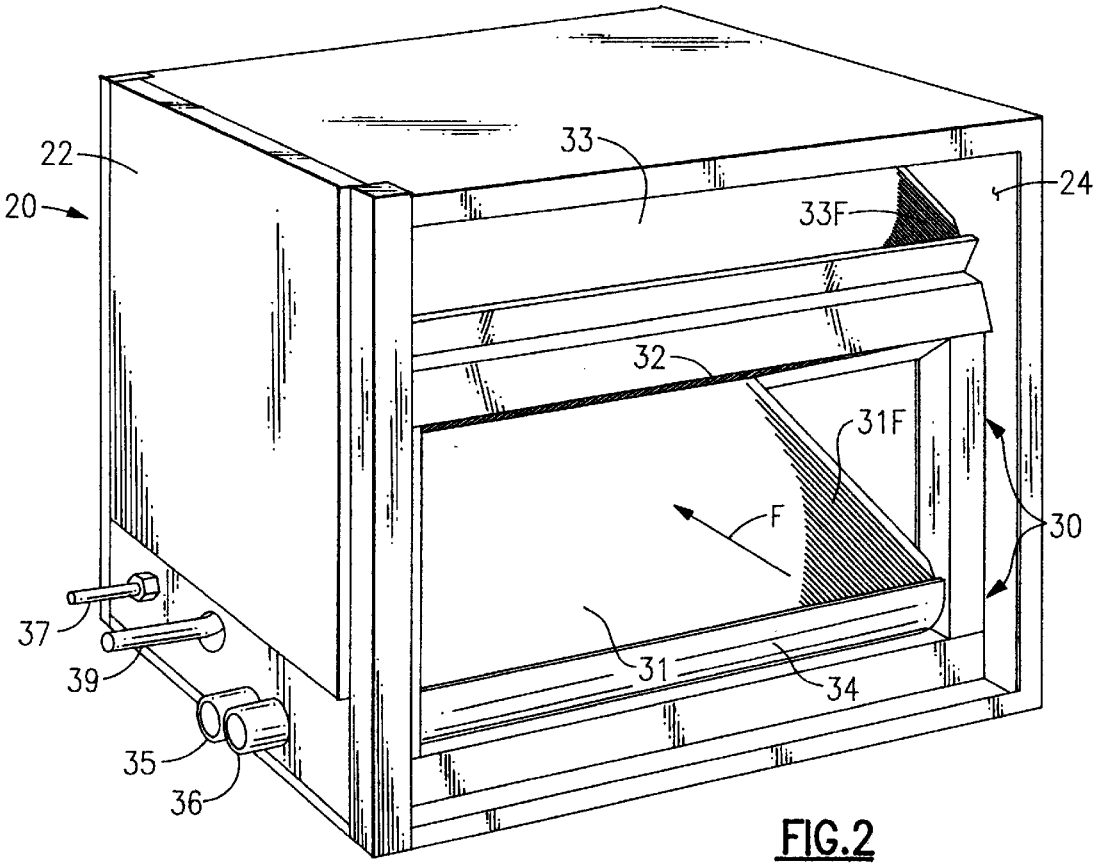
FIG. 2 is an oblique view of a heat exchanger of the type shown in FIGS. 1 A and 1B.

Referring to FIG. 2, there is shown an enlarged, oblique exterior view of heat exchanger 20 of FIGS. 1A and 1B, shown as it looks when not mounted within a duct system such as that shown in FIG. 1. As shown in FIG. 2, heat exchanger 20 includes an open ended flow through housing 22 having an intake opening 22 and an outlet opening, not visible in FIG. 2. Housing 22 encloses a heat exchanger slab assembly 30, best shown in FIG. 3, which includes three finned heat exchanger slabs 31, 32, and 33, which are generally planar in shape and have planes that form oblique angles with the direction of air flow shown by arrow F. Each of these slabs includes a pair of spaced apart redundant refrigerant coils (not shown) which are surrounded by an array of parallely disposed, closely spaced fins, which are often referred to collectively as a fin pack. The upper edges of a few representative ones of the fins of the fin packs of slabs 31 and 33 are labeled 31F and 33F, respectively in FIG. 2. As will be explained more fully later, the invention is suitable for use with slab assemblies having two or more slabs which are disposed above or below one another.

Slab assembly 30 of FIG. 2 also includes a catch pan 34 which lies below slabs 31–33, and serves to catch and collect condensate running downwardly through and from these slabs and direct the same to a pair of redundant drain lines 35 and 36, the latter of which is located slightly above the other for safety reasons. Refrigerant is supplied to the two redundant coils of each of the slabs through a refrigerant input line 37 and through a refrigerant distribution head and piping not visible in FIG. 2. Refrigerant flowing out of the slabs is directed into a refrigerant output manifold 38, best shown in FIG. 3, from which it exits housing 22 through a pipe 39.

Referring to FIG. 3, there is shown a side view of slab assembly 30, from which the refrigerant inlet system and the coil ends have been omitted for the sake of clarity. In FIG. 3 slabs 31 through 33 are seen end on, and are shown in dotted lines because they lie behind end plates that are used to secure them to the support structure or frame 40 which holds them in the desired positions relative to one another and relative to catch tray 34. This support structure includes a number of vertical plates, such as plate 41, and connecting straps, such as strap 42, which are connected together by bolts or other suitable fasteners. Since the support structures of slab assembly 30 are of a type familiar to those skilled in the art, they will not be further described herein.

Slab assemblies having configurations of the general type shown in FIG. 3 are referred to as N coils because they include three slabs which are disposed one above or below the other in a generally N shaped configuration with their ends defining two apexes A1 and A2. The present invention may, however, be practiced with any number of slabs that is greater than two and includes at least one apex. It may, for example, include two slabs which are arranged in an A or V shaped configuration and have a single apex, as shown in FIG. 4. It may also include four slabs which are arranged in a W shaped configuration and have three apexes.

As condensate forms on the fins of slab assemblies such as that shown in FIG. 3, it flows downwardly along the slab through channels defined by adjacent pairs of the fins thereof. For each overlying slab, such as slab 33, this downward flow continues until the condensate reaches the lowermost end thereof, in this case end 33L. As it flows off of this end it enters the immediately adjacent underlying slab, slab 32, at the uppermost end 32U thereof. It then flows downwardly along slab 32, where it merges with the liquid which first condensed on that slab, and then flows toward the lowermost end 32L thereof. This flow then continues from slab to slab, growing ever larger in magnitude, until it eventually reaches catch tray 34 and flows out of the heat exchanger for disposal.

Within each slab, there is little tendency for the condensate that first condenses on that slab to flow laterally across the slab. This is because the fins define channels that disfavor flow in that direction. As condensate flows from an overlying slab to an underlying slab, however, it may not do so uniformly across the width of the slab. If such a lateral non-uniformity of flow does occur for any reason, the condensate carrying capacity of the channels between the fins can be exceeded, causing condensate to be blown off of the slab assembly. Condensate can also be blown off of the slab assembly at the apexes, where condensate must cross from one slab to another. Since condensate that blows off of the slab assembly can become entrained in the flow of air through the blower and cause damage to the space to be cooled, it is important to prevent blow off from occurring.

Prior to the present invention, one approach to the problem of retaining condensate within a heat exchanger involved providing each slab with its own separate drain path and thereby preventing slab to slab flow altogether. This approach was relatively complex and costly, however, particularly since safety considerations require that all drain paths be made redundant. Another approach involved equipping each apex of a slab assembly with apex baffle and splitter plates. An example of an A coil that is equipped with an apex baffle plate and a splitter plate is shown in FIG. 4.

Referring to FIG. 4, there are shown an overlying slab 45 and an underlying slab 46 which are mounted in conventional positions relative to one another, i.e., with the uppermost and lowermost tips of their fins aligned and almost touching at an apex B. As is best seen in the simplified exploded view of apex B that is shown in FIG. 4A, the ends of plates 45 and 46 are separated by a splitter plate 47 and covered by a baffle plate 48. In operation, baffle plate 48 serves to prevent condensate from being blown off of the slab ends, and splitter plate 47 serves to receive the condensate flowing off of overlying slab 45 and distribute the same over the upper surface of underlying slab 46.

In spite of the apparently foolproof character of the above-described design, it does not solve the problem of condensate blow off. This is because, as was discovered during the making of the present invention, the air flowing through the slab assembly of FIG. 4 tends to flow toward the lateral ends of the slabs. This causes more condensate to be directed into the channels between the fins at the ends of the underlying slab than into the channels between the fins in the interior of that slab. This, in turn, caused the condensate carrying capacity of the endwardly disposed channels to be exceeded and resulted in condensate blow off It also had the undesirable effect of making an inefficient use of the underlying slab because it allowed a substantial portion of the heat transfer capacity of that slab to be unused.

In accordance with the present invention, it has been discovered that the blow off characteristics of slab assemblies can be improved by eliminating the splitter plate entirely and introducing a longitudinal and/or vertical offset between the slab ends of each apex of the slab assembly. By introducing these offsets, and by positioning adjacent slabs in relative proximity to one another, as shown in FIGS. 3 and 5A through 5C, there is created a condition under which the force of gravity causes the condensate flowing from one slab to another to distribute itself approximately uniformly across the entire widths of the slabs. This tendency of the condensate to distribute itself uniformly has been found to be sufficiently strong that it is able to overcome the force of the air flow through the heat exchanger, which tends to concentrate condensate flow towards the lateral ends of the slabs.

Figure 5A:
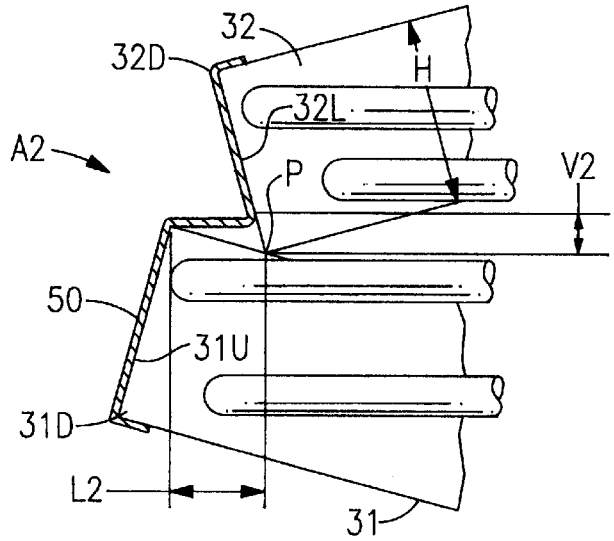
FIGS. 5A through 5C show enlarged, simplified, fragmentary end views of exemplary apexes that include slab offsets of the type contemplated by the present invention.

Referring to FIG. 5A, which is an enlarged, simplified fragmentary view of apex A2 of FIG. 3, there is shown an apex that is constructed in accordance with the preferred embodiment of the slab assembly of the invention. Apex A1 will be understood to be identical to apex A2, except that it faces in a direction opposite to that of apex A2. Since the effect of these apexes on the flow of condensate from slab to slab is similar, only one of these apexes will be described in detail herein. As shown in FIG. 5A, overlying slab 32 is displaced with respect to underlying slab 31 by a longitudinal offset L2 and by a vertical offset V2. Longitudinal offset L2 should be large enough to assure that condensate which flows off of slab end 32L encounters a downwardly sloping gradient that extends for a fluidically significant distance both outwardly and inwardly of the point at which the slabs are closest to one another. As used herein, the term "inward" means the longitudinal direction that extends toward the center of the slab assembly as a whole, and the term "outward" refers to the longitudinal direction that extends away from that center; neither term is related to the direction of air flow through the heat exchanger. It will be noted in this connection that the overlying ones 33 and 32 of the slabs at apexes A1 and A2, respectively, are both offset inwardly with respect to their underlying slabs 32 and 31, respectively.

While the size of the offset L2 can have a variety of different values, its most suitable values are those which are in the range of from about 20% to about 80% of the height H of the fin packs of the slab assembly. In embodiments of the type shown in FIG. 5A, i.e., embodiments in which the tips of the fins of the adjacent fin packs are in actual or very near contact, vertical offset V2 is a derivative quantity the magnitude of which is determined by the size of longitudinal offset L2 and the angle between the slabs and the direction of air flow.

Because the ends of the slabs are defined by an array of parallely disposed fins having individual positions that vary somewhat from slab to slab, it is not to be expected that the fins of adjacent slabs will be in actual contact with one another or even be in registry or aligned with one another. It has been found, however, that no such actual contact between or registry of the fins is necessary to produce the results contemplated by the present invention. As a result, the slab assembly of the invention may be manufactured easily and quickly without the necessity of maintaining precise alignments or tight tolerances either within the slabs or between the slabs.

Also included in the apex of the embodiment of FIG. 5A is a plate-like apex cover or shield 50 which has a generally zig-zag shaped cross-section and extends across at least that part of the slab assembly where the adjacent slabs are in immediate proximity to one another. Shield 50 serves as a physical barrier that prevents any condensate that manages to escape from the point of transfer P between the slabs from being blown off of the slab assembly and entrained in the flow of air through the heat exchanger. As a practical matter, however, shield 50 serves the function of a backup since the relative locations of the slab ends are themselves highly effective in retaining condensate within the slab assembly. In the preferred embodiment, shield 50 extends not only across the parts of the slab assembly that are in proximity to point of transfer P, but also up to and over the non-adjacent or distal edges 31 D and 32D of slabs 31 and 32, respectively. This coverage of the distal edges is desirable because, in the absence of coverage, these distal edges can act as fluidic cul de sacs from which condensate must flow against the force of the air flow through the heat exchanger in order to ultimately reach the catch tray. Thus, shield 50 ideally has a shape that conforms to the shape of the apex with which it will be used and extends to and over the non-adjacent edges of the slabs with which it is used.

Figure 5B:
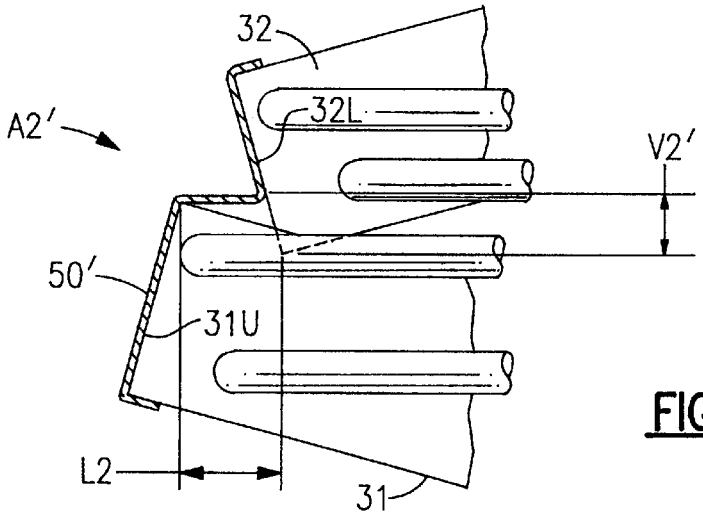

Referring to FIG. 5B, there is shown an enlarged fragmentary view of the apex of a second embodiment of a slab assembly constructed in accordance with the present invention. This embodiment is similar to that of FIG. 5A, like functioning parts being similarly numbered, except that its vertical offset V2' is sufficiently larger than that of the embodiment of FIG. 5A that the overlying and underlying slabs overlap one another and establish an interleaved relationship between their respective fins. This embodiment operates in generally the same way as the embodiment of FIG. 5A, but has the advantage that it allows much of the condensate from an overlying slab to be introduced or injected into the interior of the underlying slab before it loses contact with the overlying slab, thereby positively preventing condensate from escaping from the slab assembly as it flows from slab to slab. Because the fins of this embodiment must be properly aligned during assembly, however, this embodiment is more difficult to assemble. As a result, the embodiment of FIG. 5B is not the preferred embodiment of the present invention.

Figure 5C:
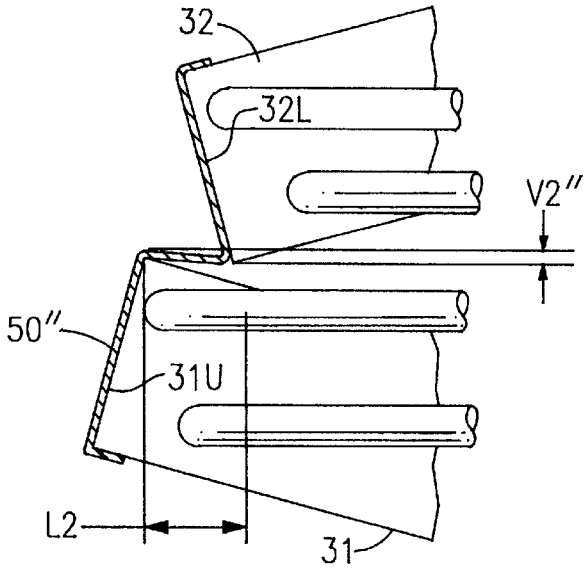
Figure 6A:
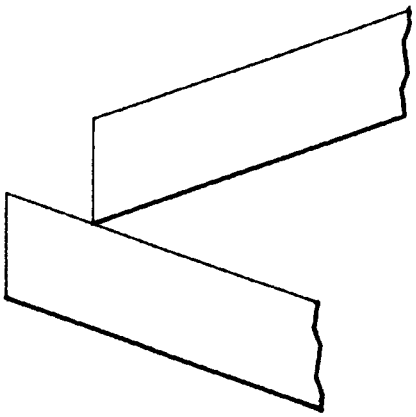
FIGS. 6A through 6D show apex configurations that may be used if the shapes of the fins of the slabs are non-rectangular.
Figure 6B:
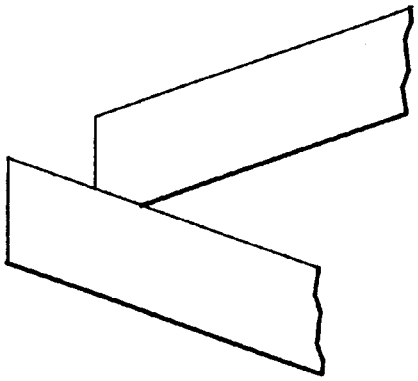
Figure 6C:
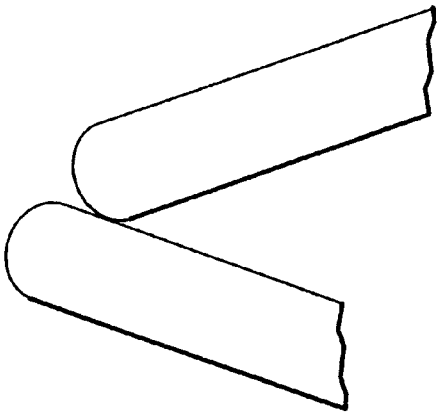
Figure 6D:
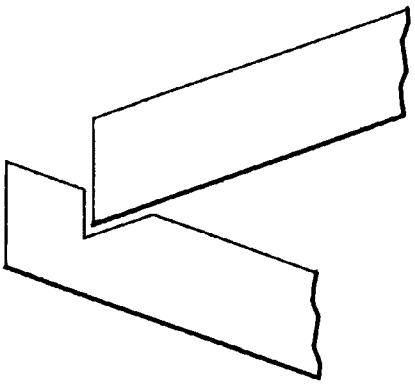

Referring to FIG. 5C, there is shown an enlarged fragmentary view of the apex of a third embodiment of the slab assembly of the invention. This embodiment is similar to those of FIGS. 5A and 5B, like functioning parts being similarly numbered, except that its vertical offset V2" is sufficiently smaller than that of FIG. 5A that an open space or gap is created between the overlying and underlying slabs. This embodiment operates in generally the same way as the embodiments of FIGS. 5A and 5B, but has the advantage that it permits the use of slab components that have looser tolerances, and can be more easily assembled than either of the two already described embodiments. It does, however, have the disadvantage that it makes the flow of condensate from the overlying slab to the underlying slab more subject to being affected by the force of the air flowing through the heat exchanger, particularly if the rate of flow of the condensate is small enough and the separation between the slabs is large enough to allow droplets of condensate to form in the gap. As a result, the maximum size of gap that permits the slab assembly to operate in the manner contemplated by the present invention cannot be stated in absolute terms; it must be determined on an application by application basis.

The embodiments of FIGS. 5A through 5C are the principal embodiments for slabs that have fins with rectangular shapes. If the fins of the slabs have non-rectangular shapes, e.g., parallelograms or closed figures having more than four sides, many additional embodiments of the invention are possible. Simplified representations of a few of the additional embodiments that are made possible by non-rectangular fin shapes are included in FIGS. 6A through 6D. Because these embodiments are so similar in principle to those already described, they will not be individually described herein, but will nevertheless be understood to be within the contemplation of the present invention.

While the present invention has been described with reference to a number of specific embodiments, it will be understood that the true spirit and scope of the present invention should be determined only with reference to the appended claims.

What is claimed is:

1. A condensate retaining apparatus for use with a heat exchanger assembly of the type that includes an air duct and at least two slabs which are generally planar in shape, and which are mounted in overlying or underlying relationship to one another within said duct, each slab having an upper end and a lower end, and forming an oblique angle with respect to the direction of air flow through said duct, each slab including a coil for conducting a heat transfer fluid and a plurality of fins which are disposed in parallel with one another, each adjacent pair of fins defining a channel for carrying a flow of condensate condensing thereon downwardly toward the lower end of the respective slab, in combination:

means for mounting said slabs so that the lower end of each overlying slab is offset inwardly from the upper end of the nearest underlying slab, each pair of adjacent slab ends defining an apex of said heat exchanger assembly;

at least one apex cover for covering respective apexes of said slabs, and thereby preventing condensate that flows from an overlying slab to an underlying slab from being blown away from said slabs and entrained in the air flowing through said duct; and means for mounting said at least one apex cover in proximity to a respective apex to shield said apex from the flow of air through said duct.

2. A condensate retaining apparatus as set forth in claim 1 further including a condensate receiving assembly for receiving condensate flowing off of the lowermost one of said slabs.

3. A condensate retaining apparatus as set forth in claim 1 in which lower end of each slab that is located above another slab is separated from the upper end of said another slab by a predetermined gap.

4. A condensate retaining apparatus as set forth in claim 3 in which each apex cover has a size and shape that allows it to bridge said gap and to cover at least those parts of the adjacent slab ends that are located in proximity to said gap.

5. A condensate assembly as set forth in claim 1 in which the fins of one of the overlying slabs has ends that are in physical contact with the fins of the nearest underlying slab.

6. A condensate assembly as set forth in claim 1 in which the fins of one of the overlying slabs have ends that are interleaved with the fins of the nearest underlying slab.

7. A condensate retaining apparatus as set forth on claim 1 in which each apex cover has a size and shape that allows it to cover at least that part of the respective apex at which the fins of the respective adjacent slabs are in closest proximity to one another and at least those portions of the slab ends which are immediately adjacent to said part.

8. A condensate retaining apparatus as set forth in claim 1 which includes two slabs that together form an A-shaped slab assembly that extends approximately across the entire height and width of said duct.

9. A condensate retaining apparatus as set forth in claim 1 in which includes three slabs that together form an N-shaped slab assembly that extends approximately across the entire height and width of said duct.

10. A condensate retaining apparatus as set forth in claim 1 which includes three or more slabs which bear a zig-zag relationship to one another and form a slab assembly that extends approximately across the entire width of said duct.

11. A condensate retaining apparatus for use with a horizontal heat exchanger assembly of the type which includes an air duct and a slab assembly that includes at least two slabs which have a generally planar configuration, and which are mounted one below the other within said duct, each slab having an upper end and a lower end, and forming an oblique angle with respect to the air flowing along the length of said duct, each slab including a coil for conducting a heat transfer fluid and a plurality of fins which are disposed in parallel with one another, each adjacent pair of fins defining a channel for carrying a flow of condensate condensing thereon downwardly toward the lower end of the respective slab, in combination:

means for mounting said slabs in overlapping end to end relationship with one another across the height and width of said duct, with the lower end of each slab that is located above another slab being offset inwardly and horizontally from the upper end of said another slab, each pair of adjacent upper and lower slab ends defining an apex of said slab assembly; and an end plate covering at least those portions of each of said pairs of adjacent slab ends which are in proximity to each of said apexes;

whereby condensate condensing on the fins of any of said slabs may flow across said apexes and downwardly through said slab assembly as a whole without becoming entrained in the air flow through said duct.

12. A condensate retaining apparatus as set forth in claim 11 further including a tray located below said slab assembly to receive condensate flowing off of the lowermost one of said slabs.

13. A condensate retaining apparatus as set forth in claim 11 in which the lower end of at least on slab that is located above another slab is separated from the upper end of said another slab by a predetermined gap.

14. A condensate retaining apparatus as set forth in claim 13 in which each end plate has a size and shape that allows it to bridge said gap and to cover at least those parts of the slab ends that are adjacent to said gap.

15. A condensate retaining apparatus as set forth in claim 11 in which the fins of a slab that is located above another slab are in physical contact with the fins of said another slab.

16. A condensate retaining assembly as set forth in claim 11 in which the fins of a slab that is located above another slab are interleaved with the fins of said another slab.

17. A condensate retaining apparatus as set forth in claim 11 in which each end plate has a size and shape that allows it to cover at least that part of the respective apex at which the fins of the respective adjacent slabs are in closest proximity to one another and at least those portions of the respective adjacent slabs which are immediately adjacent to said part.

18. A condensate retaining apparatus as set forth in claim 11 which includes two slabs that together form an A-shaped slab assembly.

19. A condensate retaining apparatus as set forth in claim 11 which includes three slabs that together form an N-shaped slab assembly.

20. A condensate retaining assembly as set forth in claim 11 which includes three or more slabs which bear a zig-zag relationship to one another.

* * * * *